United States Patent [19]

Ro

[11] Patent Number: 5,046,337

[45] Date of Patent: Sep. 10, 1991

[54] CLOTHES WASHER AND DRY CLEANER

[76] Inventor: Abraham E. Ro, 45 Deerfield Rd., Whippany, N.J. 07981

[21] Appl. No.: 483,452

[22] Filed: Feb. 22, 1990

[51] Int. Cl.[5] ..... D06F 39/08

[52] U.S. Cl. ..... 68/18 F; 68/58; 68/208

[58] Field of Search ..... 68/18 F, 58, 139, 142, 68/208, 53

[56] References Cited

U.S. PATENT DOCUMENTS

| | | | |
|---|---|---|---|
| 2,204,461 | 6/1940 | Zimarik | 68/208 |
| 2,421,803 | 6/1947 | Neal | 68/208 |
| 2,911,811 | 11/1959 | Clark | 68/208 |
| 2,932,961 | 4/1960 | Robbins et al. | 68/18 F |
| 3,144,759 | 8/1964 | Bochan | 68/208 |
| 3,314,255 | 4/1967 | Neumann et al. | 68/208 |
| 3,331,225 | 7/1967 | McCombs | 68/18 F |
| 3,863,467 | 2/1975 | Pielemeir et al. | 68/18 F |
| 4,173,875 | 11/1979 | Suprapto | 68/208 |
| 4,821,537 | 4/1989 | Zincann et al. | 68/208 |

FOREIGN PATENT DOCUMENTS

| | | | |
|---|---|---|---|
| 1151239 | 7/1983 | Fed. Rep. of Germany | 68/58 |
| 1185294 | 7/1989 | Japan | 68/208 |

*Primary Examiner*—William A. Cuchlinski, Jr.
*Assistant Examiner*—G. Bradley Bennett
*Attorney, Agent, or Firm*—Richard T. Laughlin

[57] ABSTRACT

A clothes washer or dry cleaning machine which can be side-loaded or top-loaded. The washer includes an outer casing having an axis, an inner perforated drum rotatable about an axis relative to the outer casing axis, a middle cylinder portion disposed radially between the outer casing and the inner perforated drum. A fluid supply means is provided for filling the middle cylinder portion from the overflow from the drum. Passage means is also provided for draining the overflow fluid from the middle cylinder portion and drainage means for draining the overflow fluid from the passage means.

8 Claims, 3 Drawing Sheets

CLOTHES WASHER AND DRY CLEANER

The invention relates to a clothes washer and dry cleaner apparatus, and in particular, the invention relates to such apparatus having overflow discharge means.

BACKGROUND OF THE INVENTION

The prior art clothes washer/dry cleaner is described in U.S. Pat. No. 3,526,108, issued Sept. 1, 1970. Related patents include U.S. Pat. No. 2,204,461, issued June 11, 1940, and U.S. Pat. No. 3,314,255, issued Apr. 18, 1967.

The prior art clothes washer and dry cleaner include a fixed outer casing having a door, an inner rotatable perforated drum for holding clothes during washing or dry cleaning thereof, drive means for rotating the drum relative to the casing about a common axis, fluid supply means for partly filling the casing with fluid, and fluid drain means disposed in the bottom of the casing for draining the fluid after cleaning of the clothes.

One problem with the prior art devices is that some dirt, which is at the top of the water or cleaning solvent after cleaning, passes down through the clothes during draining and remains in the clothes. Such liquid can include soap particles, lint, suspended particles and the like.

SUMMARY OF THE INVENTION

According to the present invention, a clothes washer or dry cleaning apparatus is provided. Such apparatus will be referred to herein as a washer for simplification of description. The washer comprises a 2 fixed outer casing having a door; an inner rotatable perforated drum for holding clothes during washing or dry cleaning thereof; drive means for rotating the drum relative to the casing about a common axis; a middle cylinder segment fixedly connected to the casing and disposed between the casing and the drum for holding fluid during cleaning of the clothes, fluid supply means for fully filling the middle cylinder segment from the bottom of the cylinder segment, passage means disposed between the middle cylinder segment and the casing for fluid discharge from the top of the middle cylinder segment; and fluid drain means or check valve disposed in the bottom of the casing for draining or recycling the fluid from the passage means after washing or cleaning of the clothes.

By using the middle cylinder segment and the passage means, fluid discharge does not pass through the washed clothes, so that the problem of dirt and particles passing through the clothes during draining is avoided.

The foregoing and other objects, features and the advantages of the invention will be apparent from the following description of the preferred embodiment of the invention as illustrated in the accompanying drawings.

DESCRIPTION OF THE PREFERRED EMBODIMENT

Figure 1:
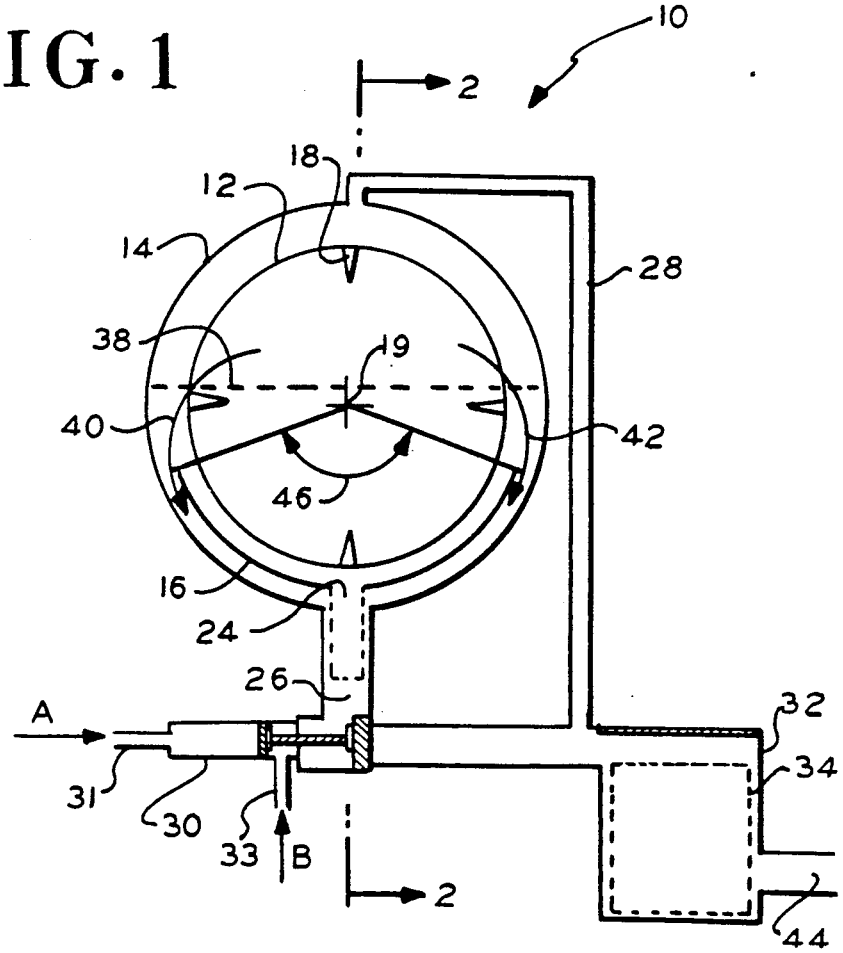
FIG. 1 is a schematic section view of a washer according to the invention.
Figure 2:
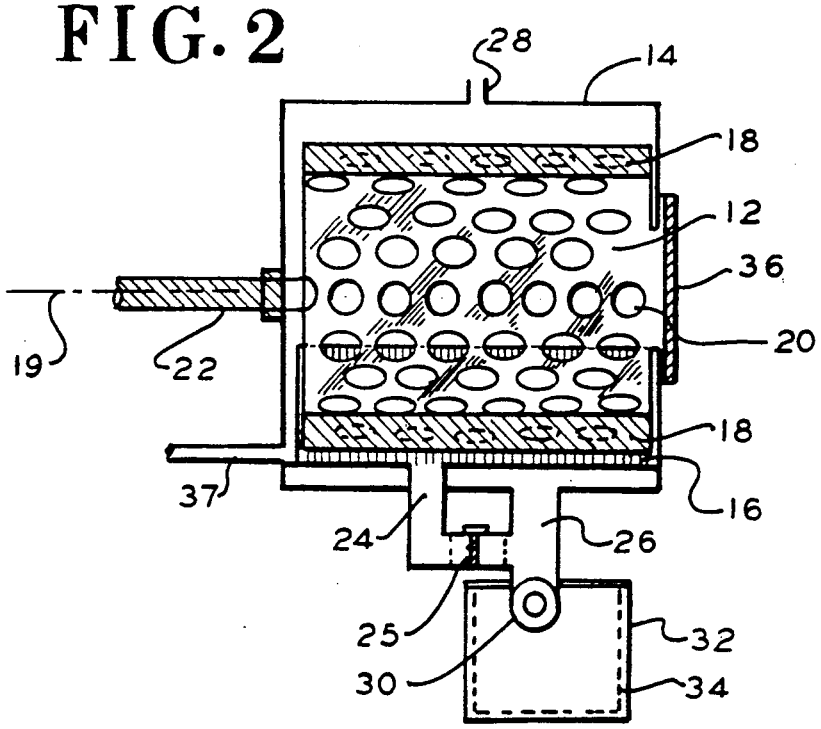
FIG. 2 is a section view as taken along line 2—2 of FIG. 1.

As shown in FIGS. 1 and 2, a clothes washer or dry cleaning machine 10 is provided. Washer 10 includes an inner, rotary, perforated drum 12 and an outer fixed casing 14, and a middle cylinder segment 16 which is fixed to the outer casing 14. Inner drum 12 can have a plurality of vanes 18. Inner drum 12 rotates relative to outer casing 14 and middle cylinder segment 16 about an axis 19.

Inner drum 12 has a plurality of perforations or drain holes 20. Inner drum 12 is fixedly connected to a drive shaft 22. Middle cylinder segment 16 has a relatively small drain line 24 for draining relatively heavy particles, or the like, which do not easily float upwardly in liquid.

Outer casing 14 has a relatively large drain line 26 for draining fluid or water at the bottom thereof. The drain line 24 is connected to the drain line 26 through a check valve 25. Outer casing 14 also has an air line or circulator line 28, which has a first end connecting to the top of outer casing 14. Outer casing 14 connects to a valve with an integral air cylinder 30, through drain line 26. Cylinder 30 has a first air line or passage 31, which has an air pressure force A. Cylinder 30 also has a second air line or passage 33, which has an air pressure force B. Cylinder 30 opens the valve when force B is greater than force A. Cylinder 30 closes the valve when force A is greater than force B.

Outer casing 14 connects through drain line 26, to a drain tank 32. Tank 32 has a lint trap basket 34. Outer casing 14 has a door 36 at an end thereof for placing clothes in the inner drum 12.

Middle cylinder segment 16 has a fluid supply line or inlet 37 for filling segment 16 with water or other cleaning liquid. Line 37 passes through and is fixedly connected to outer casing 14 and to the lower end portion of the cylinder segment 16. Inlet 37 is separated from the inner rotary drum 12. Bottom water supply causes lint, particles and the like to float to the surface and also prevents soap from depositing into the drain line or outlet.

Middle cylinder segment 16 is filled with water to a water level 38. The water or cleaning liquid overflows over the top of middle cylinder segment 16, thereby carrying dirt particles with it, so that the dirt particles do not reenter into the clothes during draining. Water flows along left path 40 within a left passage between outer casing 14 and middle cylinder segment 16. Water also flows along right path 42 within a corresponding right passage. Water passes through drain hole 26, then through valve with cylinder 30, then through lint trap basket 34 in drain tank 32, then through an outlet drain 44.

Middle cylinder segment 16 has a selective angle 46, which is disposed between left and right planes through its left and right top edges. At the initiation of the drain cycle, water pressure of drain line 24 and 26 are the same, check valve 25 is closed, then all of the water overflows through upward drain path 40 or 42. After that water pressure of drain line 24 is higher than water pressure of drain line 26, check valve 25 is started to open, then the remaining water on middle segment 16 is started to drain through drain line 24. The selective angle 46 defines the volume of water within middle cylinder segment 16.

In operation, dirt bubbles, dirt particles, melted stain particles, lint, and the like, float upwardly in the water in middle cylinder segment 16, and overflow along paths 40, 42, and drain out through drain line 26. Relatively heavy sediment, and dregs and heavy particles, and the like, move downwardly and drain out through drain line 24, and then out through drain line 26.

Figure 3:
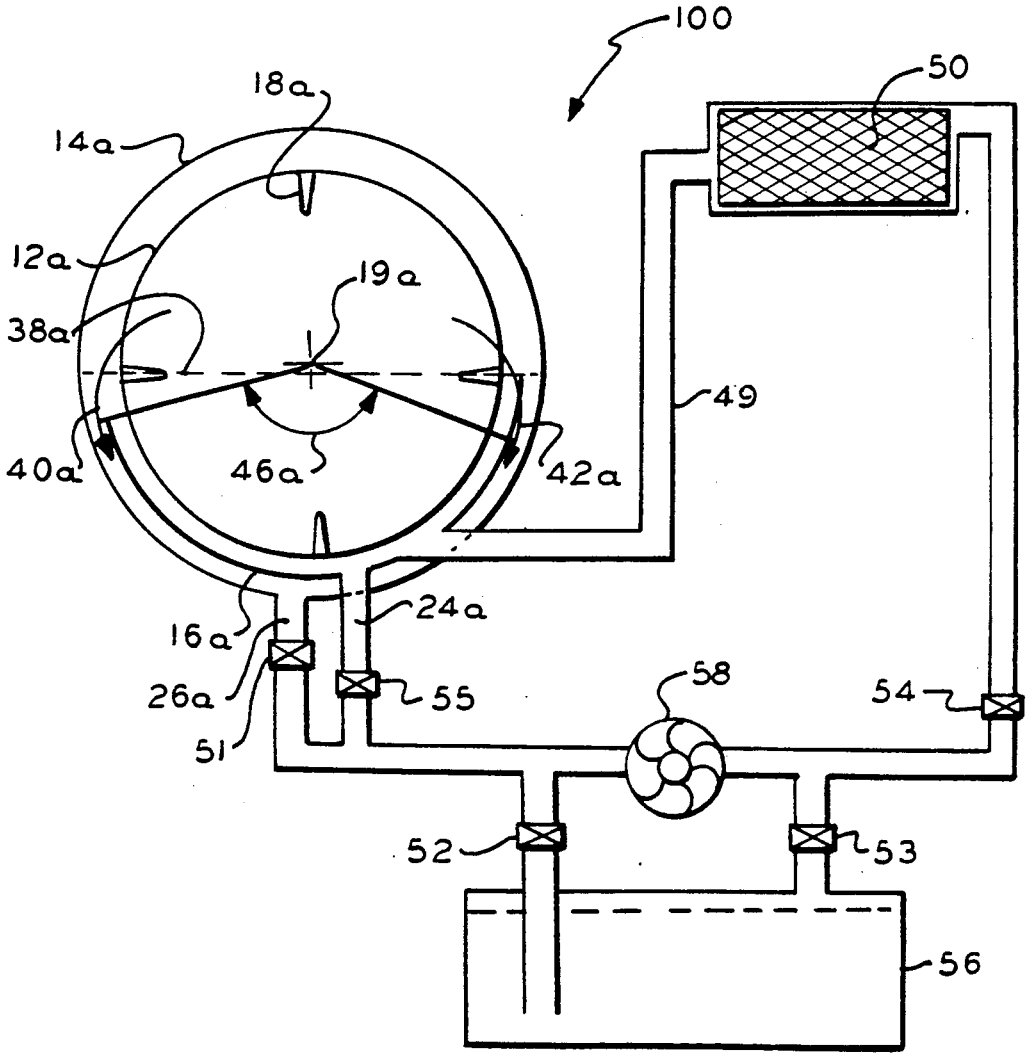
FIG. 3 is a second embodiment according to the invention.

As shown in FIG. 3, a second embodiment of a dry cleaning machine 100 is provided. Parts of embodiment 100 which are the same as corresponding parts of embodiment 10 have the same numerals, but with a subscript "a" added thereto.

Machine 100 includes an inner drum 12*a*, an outer casing 14*a*, and a middle cylinder segment 16*a*. Inner drum 12*a* has a plurality of vanes 18*a* and an axis 19*a*. Inner drum 12*a* has a plurality of perforations (not shown). Inner drum 12*a* also has a drive shaft (not shown). Middle cylinder segment 16*a* has a drain line 24*a*.

Outer casing 14*a* has a drain line 26*a*. Cleaning solvent is supplied to arcuate cylinder segment 16*a* and reaches a level 38*a*. The liquid overflows over the top of arcuate cylinder segment 16*a*, and follows left path 40*a* and right path 42*a*. The amount of cleaning liquid depends upon the size of angle 46*a*, and the rate of solvent supply, and similar factors.

Machine 100 has a conduit 49, which connects to an opening at the bottom of the arcuate cylinder segment 16*a* at bottom end thereof, and which connects to drain line 24*a* that is disposed adjacent to drain line 26*a*. Conduit 49 has a filter 50 at the top end thereof, and has in this order, a valve 54, a pump 58, a valve 55 in the drain line 24*a*, and a valve 51 to drain line 26*a*. Conduit 49 connects to a tank 56 containing cleaning solvent. Tank 56 has a first connection with a valve 53, which connects at a point on conduit 49 between valve 54 and pump 58. Tank 56 has a second connection with a valve 52, which connects at a point on conduit 49 between pumps 58 and valve 55.

The operation of machine 100 in various cycles is described in the table hereafter. The valves 51, 52, 53, 54, 55 are open or closed as indicated for each cycle.

| | CYCLE | | |
|---|---|---|---|
| Valve | Fill Drum | Wash & Rinse | Drain & Extract |
| 51 | close | open | open |
| 52 | open | close | close |
| 53 | close | close | open |
| 54 | open | open | close |
| 55 | close | close | open |

In operation, the level 38*a* of the solvent is controlled during a fill drum cycle by a switch (not shown). The wash and rinse cycle is controlled by a programmed timer (not shown). During the wash and rinse cycle, the solvent circulates continuously through filter 50. Floating dirt bubbles, dirt particles, melted stain particles, lint, and the like are drained through paths 40*a*, 42*a*, during the wash and rinse cycle bottom solvent supply causes lint and particles to flow to the surface. Relatively heavy sediment, and dregs, and particles, lint and the like, are drained through drain line 24*a* during the drain cycle. The size of angle 46*a*, and drain hole is selected for maximum wash and rinse efficiency in accordance with the size of machine 100 and the type of solvent used.

Figure 4:
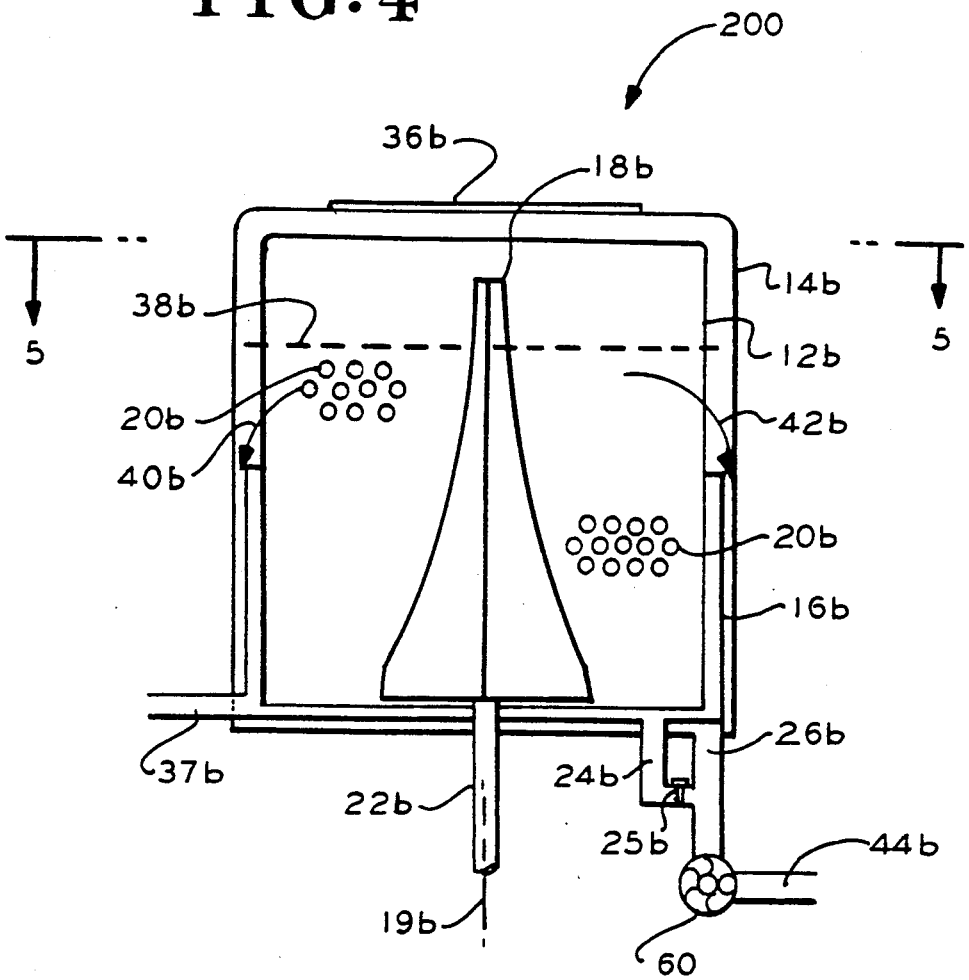
FIG. 4 is a third embodiment according to the invention.
Figure 5:
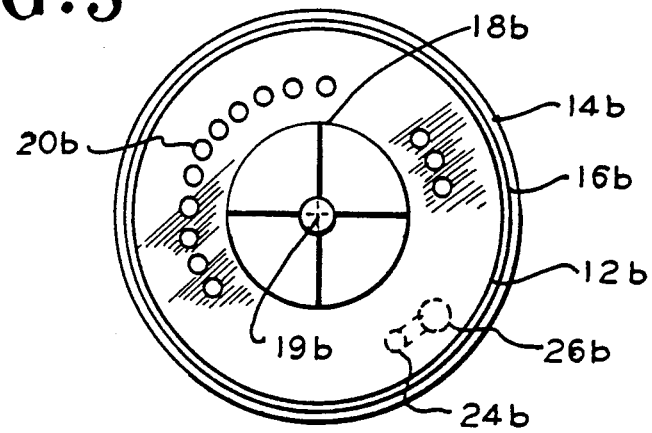
FIG. 5 is a sectional view as taken along lines 5—5 of FIG. 4.

FIGS. 4 and 5 show a third embodiment of a washer 200. Parts of embodiment 200 which are the same as corresponding parts of embodiment 10 have the same numerals, but with a subscript "b", added thereto.

Washer 200 includes an inner drum 12*b*, and outer casing 14*b*, and a middle arcuate cylinder portion 16*b*. Inner drum 12*b* has a plurality of vanes 18*b*. Middle arcuate cylinder portion 16*b* has a relatively small drain hole 24*b*. Outer casing 14*b* has a relatively large drain line 26*b*. The drain line 24*b* is connected to the drain line 26*b* through check valve 25*b*. Connecting to drain line 26*b*, is a pump 60. Water supply line 37*b* is connected to the bottom of middle arcuate cylinder portion 16*b*. Bottom water supply causes the lint and stain and the like, to float and also prevents soap from depositing in the drain hole.

Water supplied to middle arcuate cylinder portion 16*b* moves upwardly to reach a water level 38*b*, and overflows therefrom, and passes along paths 40*b*, 42*b*, then drains out through drain hole 26*b*, then passes through pump 60 and out through a main drain 44*b*. At the start of the drain cycle, water pressure of drain line 24*b* and 26*b* are the same, check valve is closed, then all the water overflows through upward drain path 40*b* or 42*b*. After that, water pressure of drain 24*b* is higher than water pressure of drain line 26*b*, check valve 25*b* is stated to open, then remained of the water on the middle cylinder segment 16*b* is started to drain through drain line 24*b*.

The advantages of machines 10, 100, 200 are indicated hereafter.

A) Overflow drain paths 40, 42 provides ease of draining of dirt bubbles, dirt particles, lint, and the like.

B) Overflow drain paths 40, 42, and related passages between outer casing 14 and middle cylinder portion 16, reduces the time of the rinse cycle thereby minimizing the amount of water required and the electric power required and the interval of time required and the cost of operation.

C) Overflow paths 40, 42 and related passages for draining off dirty fluid, and the middle cylinder portion 16, assure that the fluid discharge does not pass through the washed clothes, so that the problem of dirt passing through the clean clothes during draining is avoided.

While the invention has been described in its preferred embodiment, it is to be understood that the words which have been used are works of description rather than limitation and that changes may be made within the purview of the appended claims without departing from the true scope and spirit of the invention in its broader aspects.

What is claimed is:

1. A clothes washer or dry cleaner device comprising:

an outer casing having and axis;

an inner perforated drum rotatable relative to the outer casing about the axis;

a middle cylinder portion, disposed radially between the outer casing and the inner perforated drum;

fluid supply means for filling the middle cylinder portion with fluid and for overflow of the fluid therefrom;

passage means for draining the overflow fluid from the middle cylinder portion to the outer casing; and fluid drainage means for draining the overflow fluid from the outer casing, wherein the inner perforated drum has a plurality of inner vanes; and wherein the inner perforated drum has a plurality of perforations; and wherein the inner perforated drum has a drive means connected thereto; wherein the outer casing has a drain hole, and wherein the outer casing drain hole is connected to a shutoff valve having an actuating air cylinder with two air lines; and wherein the shutoff valve is connected to a drain tank having a lint trap basket.

2. A clothes washer or dry cleaner device comprising:

an outer casing having an axis;

an inner perforated drum rotatable relative to the outer casing about the axis;

a middle cylinder portion, disposed radially between the outer casing and the inner perforated drum;

fluid supply means for filling the middle cylinder portion with fluid and for overflow of the fluid therefrom;

passage means for draining the overflow fluid from the middle cylinder portion to the outer casing; and fluid drainage means for draining the overflow fluid from the outer casing, wherein the inner perforated drum has a plurality of inner vanes; and wherein the inner perforated drum has a plurality of perforations; and wherein the inner perforated drum has a drive means connected thereto; wherein the outer casing has a drain hole, wherein the outer casing drain hole is connected to a connection having a first shutoff valve; and wherein said first shutoff valve is connected to a conduit; said conduit having an upper end connected to an opening in the outer casing at the upper end thereof; said upper end having a filter unit; said conduit having a lower end having a pump; said conduit having a connection with a second shutoff valve connecting to a tank for a selective fluid; said conduit having a connection with a third shutoff valve connecting to the tank; said second and third shutoff valve connections being disposed on opposite sides of the pump; said conduit having a fourth shutoff valve disposed between the third shutoff valve connection and the filter unit; said conduit having a connection with a fifth shutoff valve connecting to a drain hole in the middle arcuate cylinder portion.

3. The device as defined in claim 2, wherein the axis is a vertical axis.

4. The device as defined in claim 2, containing a check valve to control the flow of fluid.

5. The device as defined in claim 2, wherein the first and second drain lines are connected through a check valve.

6. The device as defined in claim 2, wherein said fluid supply means supplies the fluid to the lower portion of the middle cylinder

7. The device as defined in claim 2, wherein the outer casing has a drain line and the middle cylinder has a second drain line.

8. The device as defined in claim 2, wherein the water supply line is connected to the bottom.

* * * * *